United States Patent [19]

Aldrich

[11] Patent Number: 4,958,461

[45] Date of Patent: Sep. 25, 1990

[54] FLORAL HOLDER AND DISPLAY

[75] Inventor: Jay L. Aldrich, Miami, Fla.

[73] Assignee: Sterling Bouquet, Miami, Fla.

[21] Appl. No.: 293,052

[22] Filed: Jan. 3, 1989

[51] Int. Cl.[5] ..... A01G 5/00

[52] U.S. Cl. ..... 47/41.01; 47/41.11

[58] Field of Search ..... 47/41.01, 41.11, 41.1, 47/41.12; 206/423

[56] References Cited

U.S. PATENT DOCUMENTS

| | | | |
|---|---|---|---|
| 387,280 | 8/1888 | Bruce | 471/41.01 |
| 1,982,432 | 11/1934 | Hull | 47/41.01 |
| 2,062,684 | 12/1936 | Thomas | 47/41.1 |
| 2,081,048 | 5/1937 | Bate | 47/41.01 |
| 3,131,511 | 5/1964 | Deaner | 47/41.01 |
| 3,158,524 | 11/1964 | Tong | 47/41.01 |
| 3,498,520 | 3/1970 | Zumpel | 47/41.01 |
| 4,551,943 | 11/1985 | Pas | 47/41.01 |
| 4,844,243 | 7/1989 | Stiles | 206/45.14 |

FOREIGN PATENT DOCUMENTS

| | | | |
|---|---|---|---|
| 478221 | 6/1929 | Fed. Rep. of Germany | 47/41 |
| 1230609 | 9/1960 | France | 47/41 |
| 941165 | 11/1963 | United Kingdom | 47/41.12 |

*Primary Examiner*—Henry E. Raduazo

*Attorney, Agent, or Firm*—Lieberman Rudolph & Nowak

[57] ABSTRACT

A floral holder and display is provided which is designed for holding and displaying floral bouquets. The display includes a bucket which is deep enough to contain flower stems. A lid is provided which is shaped and dimensioned to removably fit on the bucket. The lid is formed with a plurality of spaced apart openings thereon. A plurality of sleeves extend downward from the lid and are contained within the bucket when the lid is mounted on the bucket. Each sleeve has an upper open end in communication with a separate lid opening. Each sleeve has an open lower end in communication with the interior of the bucket when the lid is mounted on the bucket. The device provides a safe and convenient way of displaying a large number of floral bouquets.

12 Claims, 3 Drawing Sheets

FLORAL HOLDER AND DISPLAY

BACKGROUND OF THE INVENTION

The present invention relates to a display for holding and displaying a plurality of floral bouquets.

When flowers are being sold, it is important to have the flowers easily visible to the purchasing public. Since flowers are fragile, they must be displayed and held in a manner that avoids damage to the stems. Such damage often occurs when the stems intertwine.

The flower bouquets must not only be easily visible, but the bouquets should be attractively displayed in a manner that makes them easily accessible to a purchaser.

The amount of floor space for floral displays is normally limited and thus it is important for a display device to maximize the number of floral bouquets which can be attractively and safely displayed in a given amount of space.

The problems presented with the display of a number of single flowers as opposed to the display of a number of bouquets differ. Since the bouquets involve more flowers and stems they take up more space and the likelihood of damage from stem intertwining increases. Additionally, when the bouquets are displayed for resale purposes, and they are thus subjected to more movement, this likelihood increases even more.

A number of different flower holders and displays are known in the art. U.S. Pat. No. 485,417 to Lord discloses a flower holder having a number of water holding vessels which are supported on tubes attached to the flower holding vessel itself.

U.S. Pat. No. 720,132 to F. W. Green discloses a flower holder for use with a vase. The flower holder incorporates a number of individual tapered spring holders suspended downwardly from a series of metal strips.

Other examples of prior art floral holders are taught in U.S. Pat. No. 48,166 to Bennet; U.S. Pat. No. 3,158,524 to Tong; U.S. Pat. No. 4,551,943 to Pas; U.S. Pat. No. Des. 242,753 to Christen, Jr.; U.S. Pat. No. Des. 275,638 to Grier; U.S. Pat. No. 165,456 to Van Stone; U.S. Pat. No. Des. 48,239 to Booth; U.S. Pat. No. 3,131,511 to Deaner; U.S. Pat. No. 1,775,250 to Link; U.S. Pat. No. Des. 259,141 to Gooch; and U.S. Pat. No. 371,796 to Loudon.

Although the many prior art patents disclose flower holders and displays which are good for many purposes, none of these displays are useful in safely holding and displaying a large number of flower bouquets in a relatively small space for resale purposes.

Accordingly, it is the object of the present invention to provide a floral bouquet holder and display which permits a plurality of floral bouquets to be easily viewed and accessed by a purchaser.

Yet another object of the present invention is to provide such floral display which prevents the stems from the different bouquets from intertwining and thus being damaged.

Still another object of the invention is to provide such a display which permits a large number of bouquets to be shown in a relatively small amount of space.

BRIEF DESCRIPTION OF THE INVENTION

In one embodiment of the present invention, a device for holding and displaying a number of floral bouquets is provided. The display device includes a display bucket which is deep enough to contain flower stems. A lid is provided which is shaped and dimensioned to fit on the bucket. The lid is formed with the plurality of spaced apart openings thereon. A plurality of sleeves is provided. Each sleeve extends downwardly from the lid and is contained within the bucket when the lid is mounted on the bucket. Each sleeve has an open upper end which is in communication with a separate one of the openings. Each sleeve has an open lower end which is in communication with the interior of the bucket when the lid is mounted on the bucket.

DETAILED DESCRIPTION OF THE PREFERRED EMBODIMENTS

Figure 1:
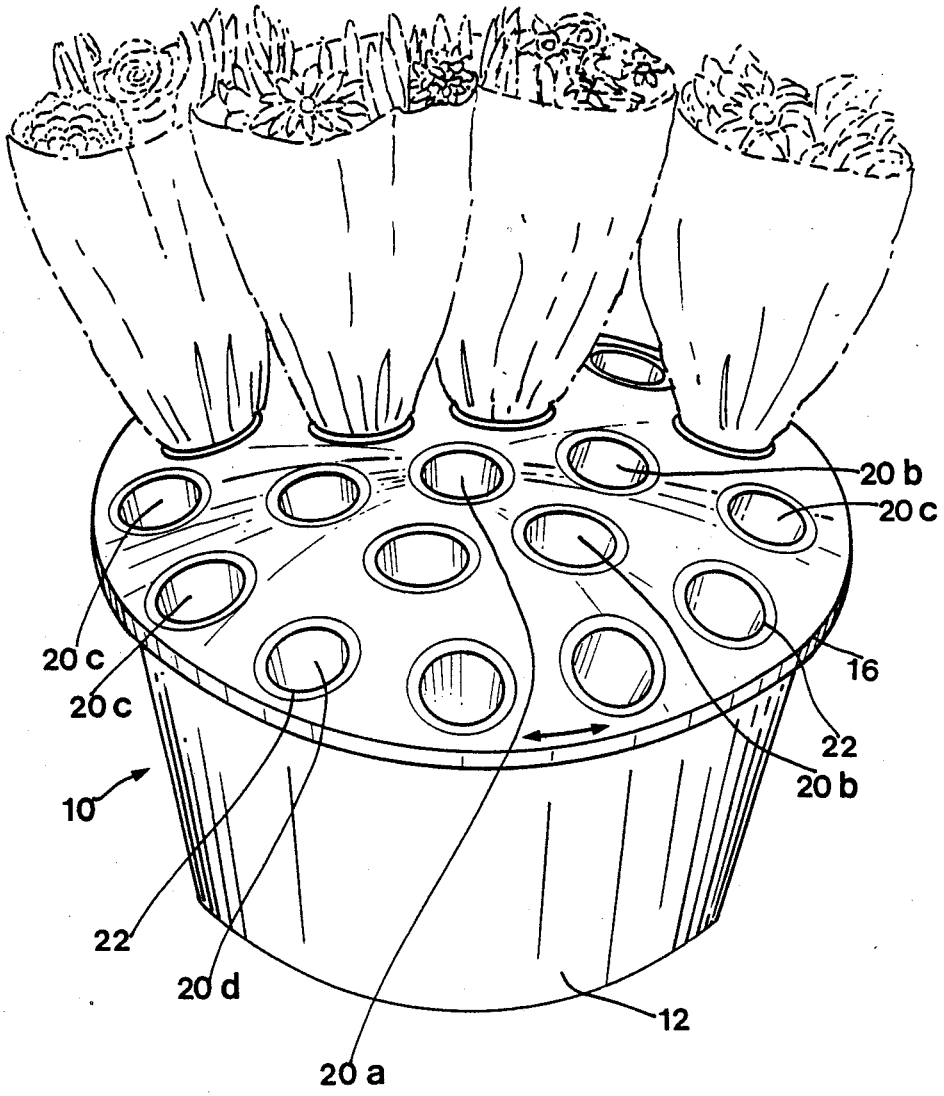
FIG. 1 is a perspective view of the floral bouquet display device of the present invention showing floral bouquets in some of the plurality of sleeves.
Figure 2:
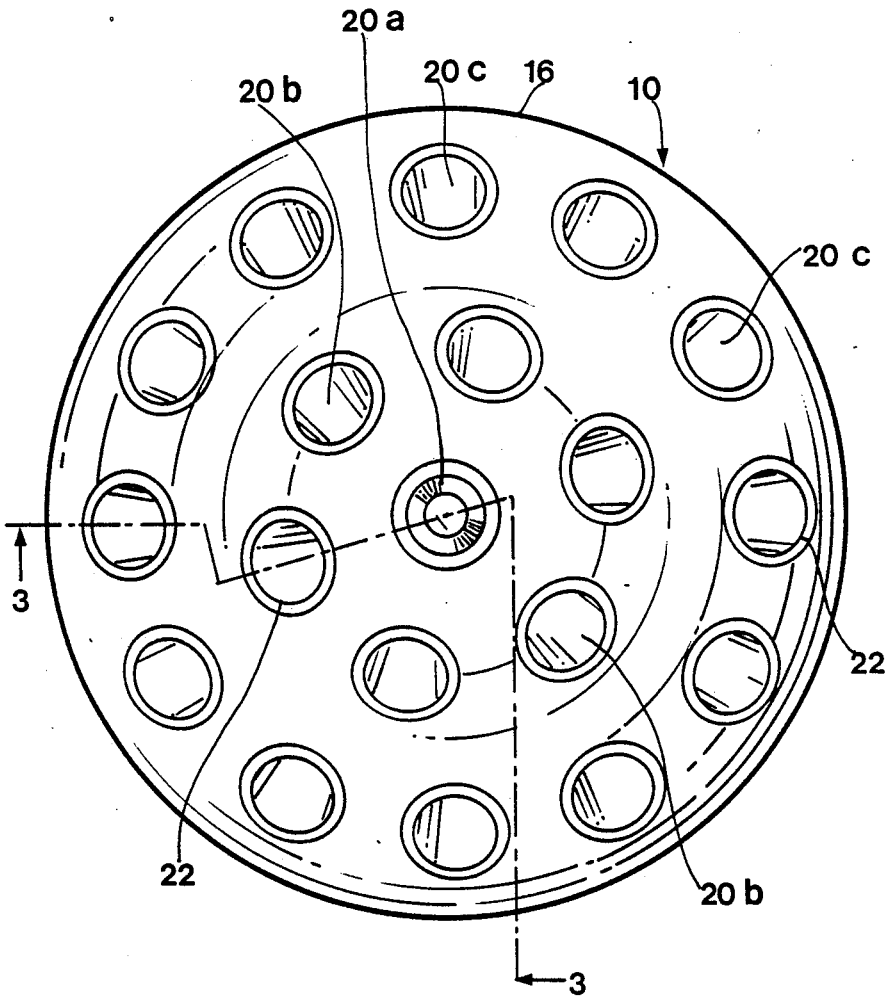
FIG. 2 is a top plan view of the FIG. 1 floral display device.

Referring now to the drawings, the reference numeral 10 denotes the floral holder of the present invention. Floral holder 10 is designed to permit the attractive display of a large number of floral bouquets in a relatively small area, and is further designed to avoid damage to the floral bouquets held therein.

Figure 3:
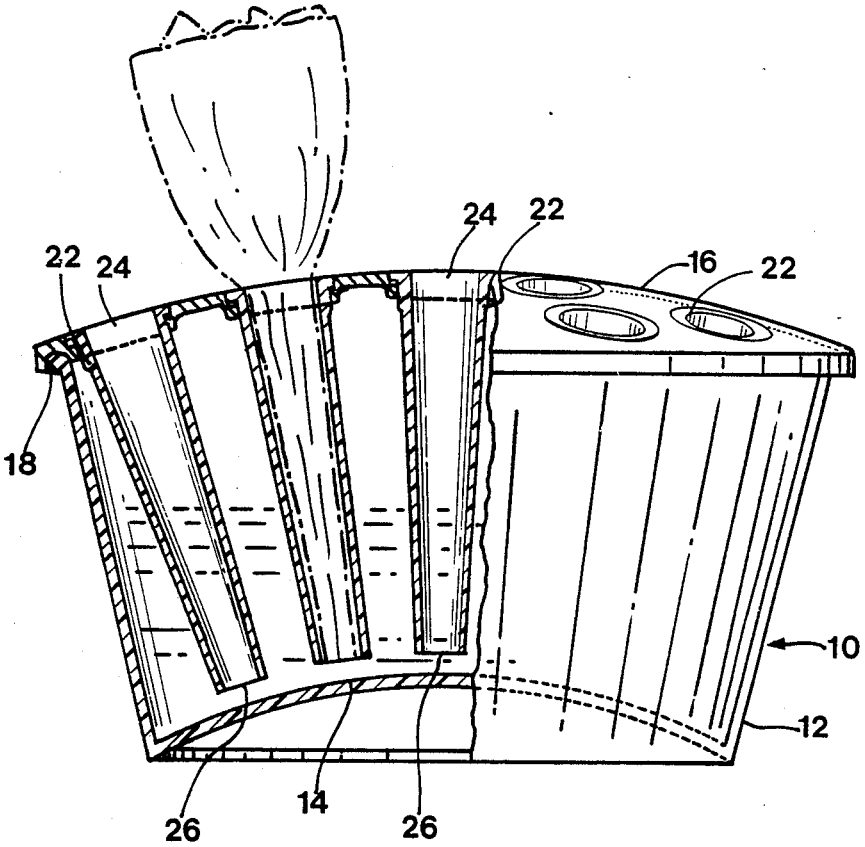
FIG. 3 is sectional view of the floral display device taken generally along the line 3—3 of FIG. 2.

Holder 10 includes a bucket 12 which is deep enough to contain flower stems. Bucket 12, in a preferred embodiment has an upper diameter of about twenty (20) inches, a lower diameter of about fifteen (15) inches and a height of about ten and one half (10½) inches. Bucket 12, as best shown in FIG. 3, has a curved inner bottom wall 14.

Associated with bucket 12 is lid 16 which is shaped and dimensioned to removably and securely fit on bucket 12. As shown in FIG. 1, lid 16 is connected to bucket 12 for rotational movement about the upper circumferential ridge 18 of bucket 12. Bucket 12 with lid 16 is stable and thus substantially tip proof. Both the bucket and lid are easily cleaned.

The lid 16 is formed with a plurality of spaced apart openings 20 thereon and in a preferred embodiment, nineteen (19) openings 20 are provided which include a central opening **20*a*, surrounded by a first ring of six (6) openings 20*b* which in turn are surrounded by a second ring of twelve (12) openings 20*c***.

Nineteen sleeves 22 are provided. Each sleeve 22 extends downward from the lid 16. Each sleeve 22 is contained within the bucket 12 when the lid 16 is mounted on the bucket. Each sleeve 22 has an upper open end 24 in communication with a separate one of the lid openings 20. Each sleeve 22 has an open lower end 26 in communication with the interior of the bucket when the lid is mounted on the bucket.

Sleeves 22 are supported on lid 16 and move with said lid when the lid is moved about the bucket in a counter or clockwise manual rotation.

Each of the sleeves 22 are shaped and dimensioned to hold the stems of flowers in a floral bouquet. When the sleeves 22 are in bucket 12 they do not contact the inner bottom wall 14 of the bucket. In a preferred embodiment, there is at least 0.50 inch between the inner bottom wall 14 of the bucket and the lower open ends 16 of the sleeves. This allows water or preservation solution to rise to a level equal to all of the sleeves. The distance between each open end 26 of each sleeve 22 and the inner bottom wall 14 of the bucket is the same.

Lid 16 is convexly curved to provide an appropriate base to display the bouquets and further to aid in eliminating any foreign matter from falling into bucket 12.

Inner bottom wall 14 is convexly curved. In the preferred embodiment of the invention, the radius of curvature of the lid and the radius of curvature of the inner bottom wall have the same centerpoint. When flowers with appropriate length stems are used, and these stems are placed in the bucket such that the stem bottoms touch the inner bottom wall 14, the curve of said inner bottom wall causes the flower to display on the lid with an attractive arc.

Sleeves 22 guide the stems of the flowers to the bottom of the bucket. The first ring of lid openings **20*b* and the central axes of the sleeves associated with these openings are at a 9° angle to the central axis of the lid. The second ring of lid openings 20*c* and the central the axes of the sleeves associated with these openings are at a 19° angle to the central axis of the lid. The central axis of the sleeve associated with the central lid opening 20*a* is parallel to the central axis of the lid. This arrangement allows display 10** to hold a large number of bouquets safely and attractively in a relatively small area. It is also critical in preventing the sleeves from touching one another to thus allow the removal of one bouquet without the stems of that bouquet intertwining with the stems of another bouquet.

Sleeve 22, by isolating the separate bouquets from one another, prevent buyers from inadvertently removing more than one bouquet.

In a preferred embodiment, display 10 is formed of injected molded polyethylene. Display 10 is formed with no sharp edges or corners that could damage or otherwise cut the floral stems. The lid 16 rotates about the bucket so that a customer can turn the lid, which carries the floral bouquets in order to view the flowers from any angle.

While the invention has been illustrated and described as embodied in a floral holder and display, it is not intended to be limited to the details shown, since various modifications and structural changes may be made without departing in any way from the spirit of the present invention.

Without further analysis, the foregoing will so fully reveal the gist of the present invention that others can by applying current knowledge readily adapt it for various applications without omitting features that, from the standpoint of prior art, fairly constitute essential characteristics of the generic or specific aspects of this invention and, therefore, such adaptations should and are intended to be comprehended within the meaning and range of equivalence of the following claims.

What is claimed is:

1. A device for holding and displaying a plurality of floral bouquets which comprises:

a bucket deep enough to contain flower stems, said bucket having a convexly curved inner bottom wall;

a convexly curved lid shaped and dimensioned to removably fit on said bucket, said lid being formed with a plurality of spaced apart openings thereon; and a plurality of conical sleeves supported by said lid and extending downward from said lid and contained within said bucket when said lid is mounted on said bucket, each sleeve having an upper open end in communication with a separate one of said lid openings, each sleeve having an open lower end in communication with the interior of said bucket when said lid is mounted on said bucket.

2. A device of claim 1, wherein said bucket has an inner bottom wall and wherein said sleeves are of a length such that none of said sleeves, when in said bucket, contact the inner bottom wall of the bucket.

3. A device of claim 2, wherein there is a space of at least 0.50 inch between the bottom of said sleeves and said inner bottom wall of said bucket.

4. A device of claim 1, wherein said sleeves are of a length such that none of said sleeves, when in said bucket, contact the inner bottom wall of said bucket.

5. A device of claim 1, wherein said lid is capable of rotational movement about the upper circumference of said bucket.

6. A device of claim 5, wherein said sleeves are supported by said lid and rotate therewith.

7. A device of claim 1, wherein there are nineteen spaced apart lid openings and nineteen sleeves, each sleeve being associated with a lid opening.

8. A device of claim 7, wherein said nineteen lid openings include an uppermost central opening, a first ring of a first group of openings surrounding said central opening, and a second ring of a second group of openings surrounding said first ring of a first group of openings, said second group of openings being greater in number than said first group of openings.

9. A device of claim 8, wherein the central axis of each sleeve associated with said first ring of openings is at an angle of substantially 9° to the central axis of said lid, the central axis of each sleeve associated with said second ring of openings at an angle of substantially 19° to the central axis of said lid, and the central axis of the sleeve associated with said central opening is parallel to the central axis of said lid.

10. A device of claim 1, wherein said sleeves are isolated from each other when supported by said lid.

11. A device of claim 1, wherein said bucket has an upper diameter of about twenty (20) inches, a lower diameter of about fifteen (15) inches and a height of about ten and one half (10½) inches.

12. A device for holding and displaying a plurality of floral bouquets, said device comprising:

a bucket, said bucket being deep enough to contain floral stems, said bucket including a curved inner bottom wall;

a lid shaped and dimensioned to removably fit on said bucket, said lid being formed with a plurality of spaced apart openings thereon; and a plurality of sleeves, each of said sleeves extending downward from said lid and contained within said bucket when said lid is mounted on said bucket, each sleeve having an upper open end in communication with a separate one of said lid openings, each sleeve having an open lower end in communication with the interior of said bucket when said lid is mounted on said bucket;

said sleeves being supported by said lid;

none of said sleeves when within said bucket, contacting said curved inner bottom wall of said bucket, the distance between the open lower end of each sleeve and the curved inner bottom wall of said bucket being equal.

* * * * *